US007181808B1

(12) United States Patent
Van Winkle

(10) Patent No.: US 7,181,808 B1
(45) Date of Patent: Feb. 27, 2007

(54) BUCKLE OR CLASP

(76) Inventor: Denzal Wayne Van Winkle, 2424 Wedgewood Dr., Santa Maria, CA (US) 93455-1517

( * ) Notice: Subject to any disclaimer, the term of this patent is extended or adjusted under 35 U.S.C. 154(b) by 0 days.

(21) Appl. No.: 11/421,258

(22) Filed: May 31, 2006

(51) Int. Cl.
*A44B 11/12* (2006.01)

(52) U.S. Cl. ..... 24/191; 24/170; 24/174

(58) Field of Classification Search ..... 24/163 R, 24/167, 163 FC, 166, 173–180, 191, 316, 24/317; D11/230–232
See application file for complete search history.

(56) References Cited

U.S. PATENT DOCUMENTS

| | | | | | |
|---|---|---|---|---|---|
| 400,624 | A | * | 4/1889 | Yarger | 24/174 |
| 975,063 | A | * | 11/1910 | Nelson | 24/316 |
| 1,854,257 | A | * | 4/1932 | Heileman | 24/191 |
| 1,856,775 | A | * | 5/1932 | Meehan | 24/180 |
| 1,856,776 | A | * | 5/1932 | McDermott et al. | 24/180 |
| 2,091,685 | A | * | 8/1937 | Meehan | 24/180 |
| 3,886,632 | A | * | 6/1975 | Bako | 24/180 |
| D264,767 | S | * | 6/1982 | Spreter | D11/230 |
| 5,189,763 | A | | 3/1993 | Voumard | |
| 5,212,838 | A | | 5/1993 | Davidson et al. | |
| 5,548,878 | A | | 8/1996 | Romagnoli | |
| 5,896,626 | A | * | 4/1999 | Birkenstock | 24/180 |
| 6,453,519 | B1 | | 9/2002 | Gelardi | |
| 6,766,540 | B2 | | 7/2004 | Kawashima | |
| 6,941,620 | B1 | | 9/2005 | Hinds | |
| 2006/0070215 | A1 | | 4/2006 | Sung | |

* cited by examiner

*Primary Examiner*—Robert J. Sandy
*Assistant Examiner*—Ruth C. Rodriguez
(74) *Attorney, Agent, or Firm*—Law Office of Tim Cook P.C.

(57) ABSTRACT

A fastener is adapted to retain one or more holes of a belt or strap beneath a belt frame without passing through the frame. The fastener comprises primarily a frame and a back plate, coupled together for relative rotational movement about an axis parallel to the axial orientation of the strap. The frame also serves as a biasing member to engage a latch mechanism. The back plate anchors the member-to-be-secured, if it is a belt. Otherwise, if the member-to-be-secured is a strap to, for example, close a pocket, then the back plate is mounted to the body on which the pocket is mounted, such as a purse or a piece of luggage. A faux tongue gives the appearance of a known buckle, but the faux tongue does not pass through the belt or strap.

18 Claims, 4 Drawing Sheets

FIG. 4
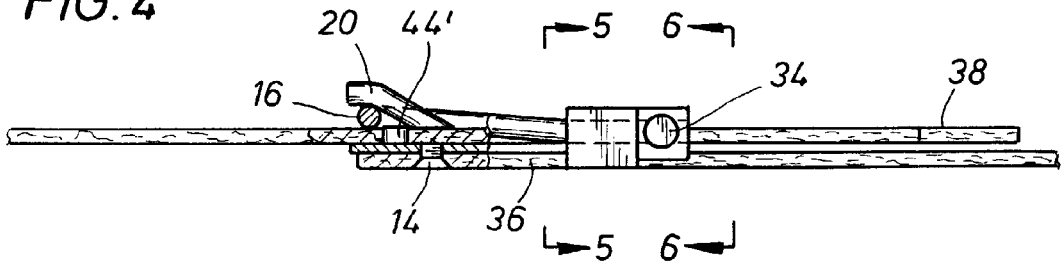
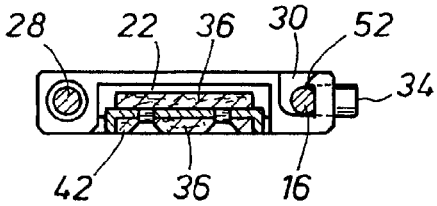
FIG. 5
FIG. 6
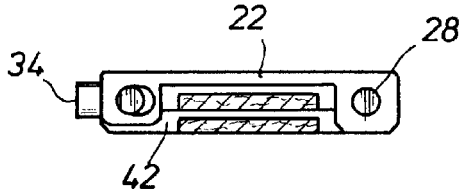
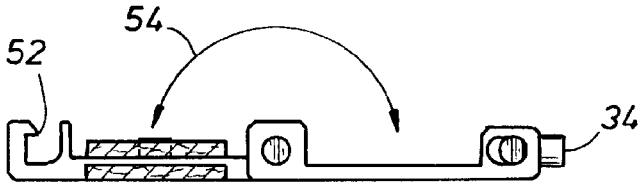
FIG. 7
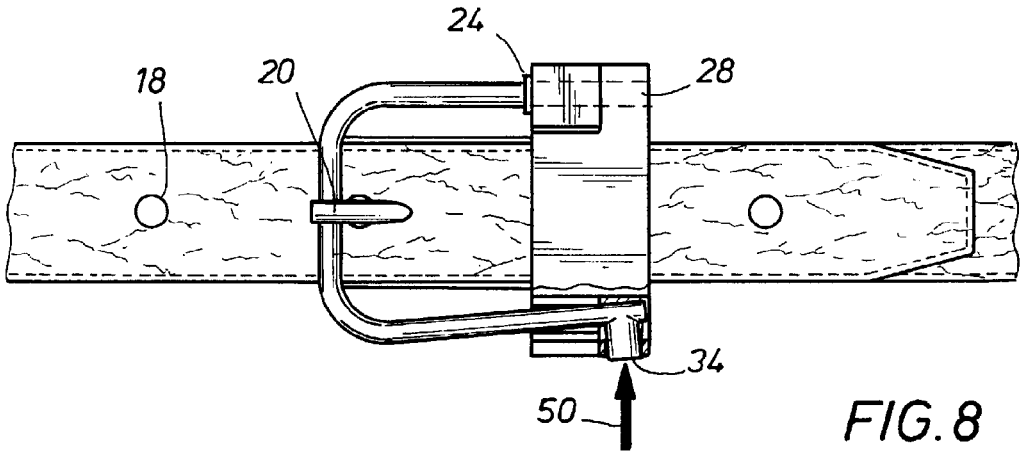
FIG. 8

BUCKLE OR CLASP

FIELD OF THE INVENTION

The present invention relates generally to the field of fastening mechanisms such as buckles, clasps, and the like and, more particularly, to a secure buckle or clasp mechanism that is nevertheless easily opened and shut.

BACKGROUND OF THE INVENTION

The present invention relates to a fastener referred to herein as a buckle in the form of a securing means having two connected relatively movable members. A strap, belt, or the like to secured at one end to the fastener and the other end of the strap passes through the fastener or is otherwise grasped by the fastener. The strap or belt passes through the fastener in a path generally parallel to the longitudinal axis of the members.

This type of buckle is usually designed to secure or tighten a belt, band, or a similar article and is generally operated by having one end of the belt, band, etc., fixedly secured to one end of the buckle with another portion of the buckle frictionally or resiliently securing the belt or band or by passing through a provided for aperture in the belt or band.

The present invention is also particularly adapted to function as a clasp, wherein one end of a strap is fixed to an article, such as for example a purse or bag, while the other end of the strap passes through and is secured by the fastener of the present invention. Thus, the term "fastener" in this disclosure defines a buckle, a clasp, or other structure having the structural components shown and described below.

These types of fasteners have a wide variety of applications. Most commonly, these types of fasteners are used to adjustably secure a pair of pants on a wearer. However, millions of these types of fasteners are applied to luggage and similar articles to hold a pocket closed, for example, and other types of applications to numerous to mention.

Designers have long tried to make such fasteners more esthetically pleasing while maintaining the strength of flexibility of the fastener. In the most common form of fastener, the end of a strap or belt is passed through a loop, referred to herein as a "frame" and then a tongue is passed through one or more of a plurality of holes in the belt. The end of the belt is then threaded through a loop to retain the belt flush against itself. To remove the belt from the buckle, the belt is grasped and pulled back through the retaining loop until the tongue can be removed from the hole in the belt. The belt is then withdrawn from the frame to undo the belt.

In many applications, the buckle or clasp is seldom used, and thus the belt or strap is very stiff. Thus, it takes a great deal of effort to grasp and withdraw the belt or strap from the securing loop to the point at which the tongue can be removed from the hole in the belt. In some applications, the strap is formed of two or more layers of stiff material and the holes therethrough are lined with a metal grommet or the like. For particularly stiff straps, the operations of securing and opening these types of fastener can prove difficult for the normal person. For those with arthritis or weakness in the hands, it can prove impossible.

Even for those users and applications in which no difficulty is encountered in using the fastener, typically the same hole is used over and over again in securing the fastener. Over time, the strap becomes worn and clearly shows the position of the frame on the strap. If the strap is made of an inferior material, or is subjected to the limit of the strap's load, the strap can even part at the point where it is used over and over again.

Thus, there remains a need for a buckle or clasp that is easy to use, whether making up a connection with a fastener or opening up the fastener. Further, the buckle or clasp should be secure and should be esthetically pleasing. There is also a need for a fastener which applies a linear stress to the holes of the strap so that the strap will not clearly shows signs of repetitive stress. The present invention is directed to such a fastener.

SUMMARY OF THE INVENTION

The present invention addresses these and other needs in the art by providing a fastener adapted to retain one or more holes of a belt or strap beneath a belt frame without passing through the frame. The fastener comprises primarily a frame and a back plate, coupled together for relative rotational movement about an axis parallel to the axial orientation of the strap. The line of relative movement is preferably a hinge, formed in part by the frame, but may also comprise some other structure functioning as pivot line.

The frame also serves as a biasing member to engage a latch mechanism. The back plate anchors the member-to-be-secured, if it is a belt. Otherwise, if the member-to-be-secured is a strap to, for example, close a pocket, then the back plate is mounted to the body on which the pocket is mounted, such as a purse or a piece of luggage. A faux tongue gives the appearance of a known buckle, but the faux tongue does not pass through the belt or strap, as in the art.

In addition to the applications in which the present invention may be used on a belt to hold up a pair of trousers, or used to secure a strap on a piece of luggage, the present invention may also be applied to small fasteners, such as for example a watch band. This invention is especially well adapted to this use because those with poor dexterity can simply press against the side of the fastener and it comes loose, rather than trying to thread the band out through a buckle frame. Thus, in the description and claims to follow, where a belt is described as having one end secured to the fastener of this invention and the other end free, it is to be understood that this application may indeed include a watch or other element secured in line with the band or strap.

The present invention also finds application in belts which ordinarily tie around a coat or similar apparel. Typical H-shaped buckles are often difficult to use, and the user often ends up simply tying the belt of a coat in a knot, rather than taking the time to thread the belt through the H-shaped buckle. This difficulty is eliminated by the present invention.

These and other features and advantages of the present invention will be apparent to those of skill in the art from a review of the following detailed description along with the accompanying drawings.

BRIEF DESCRIPTION OF THE DRAWINGS

FIG. 4 is a side section view of the fastener with an attached belt.

FIG. 5 is a section view of the fastener taken along sections lines 5—5 of FIG. 4.

FIG. 6 is a section view of the fastener taken along sections lines 6—6 of FIG. 4.

FIG. 7 is a section view of the fastener, illustrating the opening of the fastener, as taken along section lines 7—7 of FIG. 2.

FIG. 8 is a top view of the fastener in partial section showing the opening operation of the fastener.

DETAILED DESCRIPTION OF A PREFERRED EMBODIMENT

Figure 1:
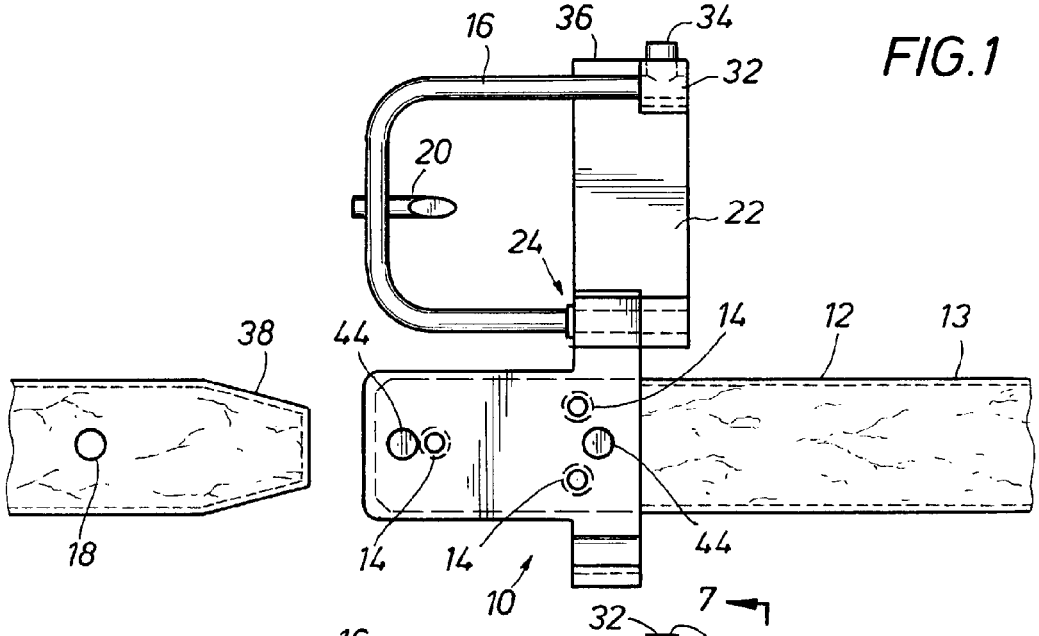
FIG. 1 is a top view of a fastener of the present invention with a belt attached thereto and withdrawn from the fastener.

FIG. 1 shows a fastener 10 of the present invention with a belt 12 attached to the fastener. If the structure of the fastener 10 described herein is used as a clasp, then the belt 12 will not be attached to the fastener but to a body such as for example a piece of luggage or the like. In the embodiment of FIG. 1, the belt 11 is secured to the fastener 10 with a plurality of rivets 14, for example, although other attaching means may be used. Further, the belt or strap defines a long edge 13, the relevance of which will become apparent from the description to follow.

Figure 2:
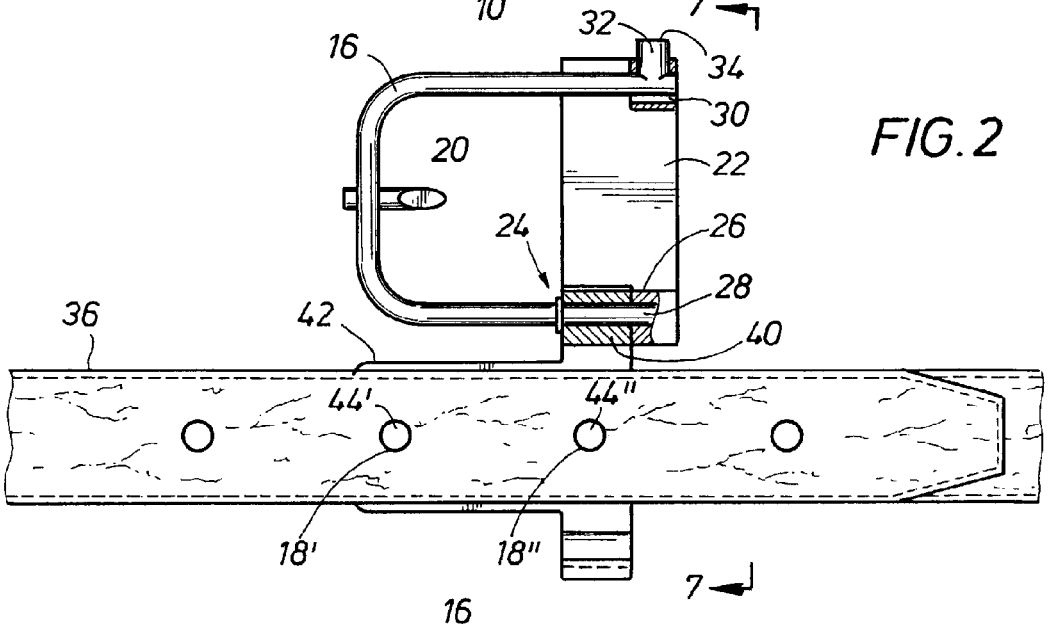
FIG. 2 is a top view of the fastener with the belt inserted in the fastener but with the fastener open.

The fastener comprises a frame 16 in the form of a loop. In known buckles, a tongue penetrates one of a plurality of holes, such as a hole 18, but in the present invention, a faux tongue 20 is joined to the frame 16, such as by welding, brazing, gluing, or the like. The frame 16 is also joined to a cross member 22, which forms a part of a rotary coupling or hinge 24, which is also shown in FIG. 2. The cross member spans across the frame, so that one end of the frame defines a part of the hinge 24, and the other end of the frame is movably held within the cross member. The rotary coupling or hinge 24 comprises a bearing member 26 and a pin 28, which is integrally formed with the frame 16. Regardless of the structure of the hinge 24, rotational movement is parallel to the long edge 13, in accordance with the teachings of this invention. Note that, in typical buckles or clasps which include a pin coupling a tongue to a frame, the axis of rotation between the frame and the pin is perpendicular to the long edge of the belt or strap.

The other end of the cross member 22 defines a chamber 30 which encloses an actuator 32. The actuator 32 is also integrally formed with the frame 16 and includes a button 34 which extends beyond an outer edge 36 of the cross member 22. Pressing down on the button 34 bends the frame 16 disengages a latch to open the fastener, as shown and described below.

The pin 28 also passes through a bearing member 40 formed in a back plate 42. Thus, the frame 16 rotates about the pin 28, supported by the coaxial bearing members 26 and 40, relative to the back plate 42. The back plate 42 also includes at least one hole-engaging pin 44, of which two such pins 44 are shown in FIG. 1.

Figure 3:
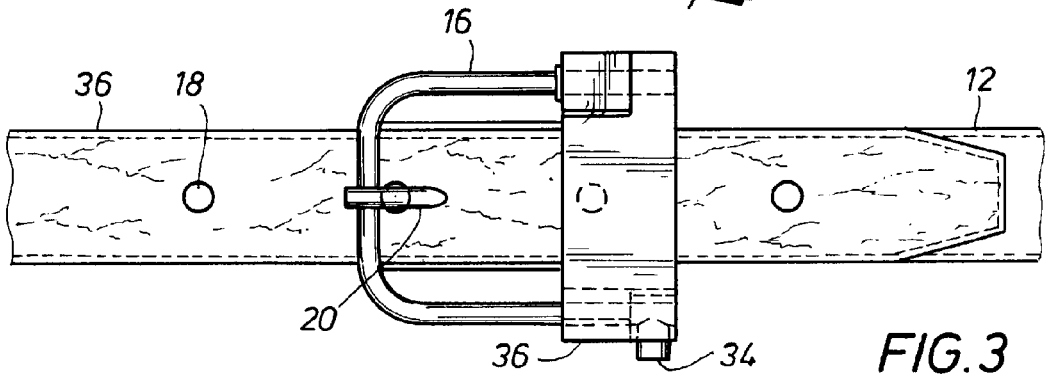
FIG. 3 is a top view of the fastener with the belt inserted in the fastener and the fastener closed.

FIG. 1 illustrates a strap or belt 12 with a strap or belt end 38 disengaged from the fastener 10. In FIG. 2, a first hole 18' has been engaged with a first hole-engaging pin 44' and a second hole 18" has been engaged with a second hole-engaging pin 44". However, the fastener 10 is still open. In FIG. 3, the frame 16 has been rotated about the pin 18 so that the fastener is closed. The faux tongue 20 rests atop or in close proximity to the belt 12. Note that, since the belt is not threaded through the frame, and is not engaged by a tongue as in the prior art, the belt remains flat and there is no point of abrasion of the surface of the belt. The faux tongue gives the illusion that the fastener of this invention works the same as other similar buckles known in the art, but may be eliminated, if desired.

FIGS. 4 through 7 illustrate side views of the fastener 10 to more clearly illustrate the engagement of a belt or strap within the fastener. FIG. 4 is a side view showing the relative arrangement of the belt or strap and the fastener. One end of the belt 12 is affixed to the fastener, for example with rivets or screws 14, while the end 38 extends beyond the fastener. This view clearly shows that the belt or strap is not bent by the fastener, thereby extending the life of the belt and eliminating the tell-tale signs of points at which the belt is secured to the fastener, for example as one gains weight.

FIG. 5 is a section view taken along section lines 5—5 of FIG. 4 and FIG. 6 is a section view taken along section lines 6—6. In FIG. 5, one can clearly see the positioning of the button 34 which is contiguous to the frame 16, so that as the button 34 is depressed, as illustrated in FIG. 8 in the direction of an arrow 50, the frame 16 moves within the chamber 30. Depressing the button far enough moves the frame 16 beyond an edge 52, freeing the frame from the chamber 30 and permitting the opening of the fastener. The end result of the opening of the fastener is thus depicted in FIG. 7.

Figure 9:
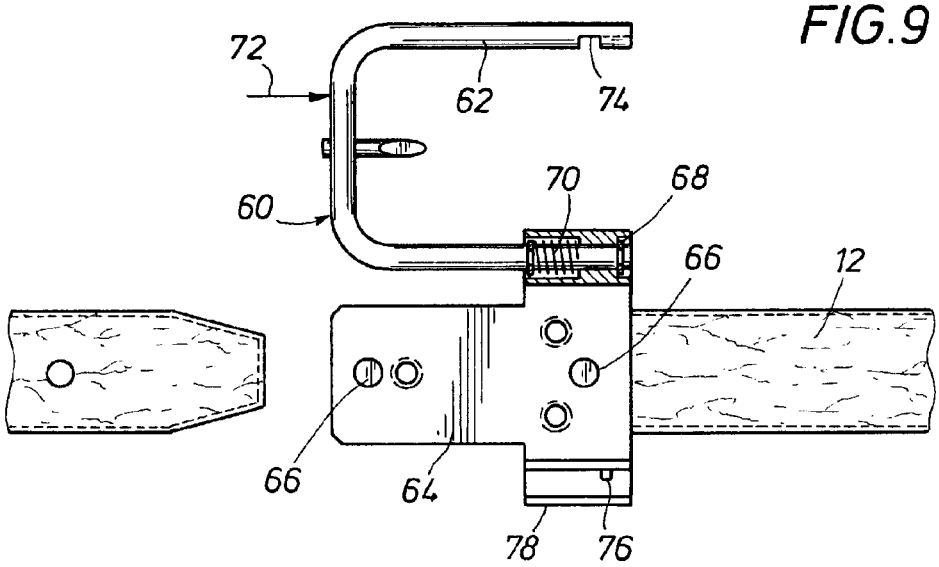
FIG. 9 is a top view of another preferred embodiment of this invention in which the latch mechanism includes a separate biasing means.
Figure 11A:
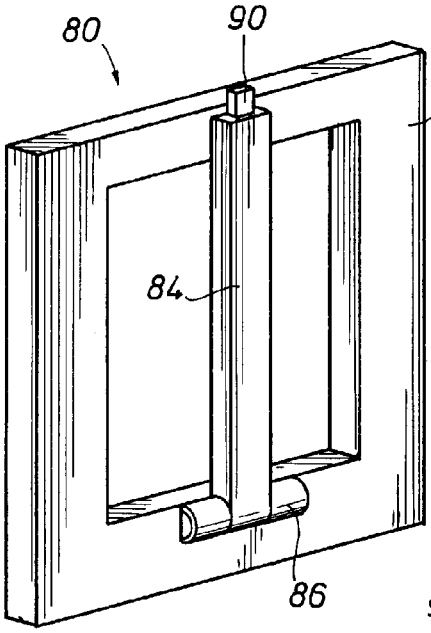
FIG. 11A is a perspective view of another preferred embodiment of a fastener including an H-shaped frame for certain specialty belts.
Figure 11B:
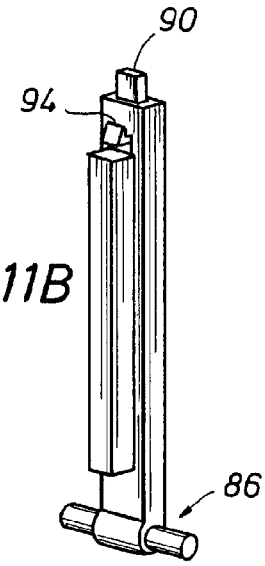
FIG. 11B is a perspective view of the fastener of FIG. 11A.
Figure 11C:
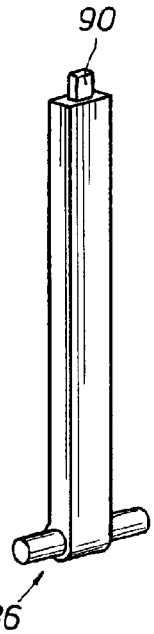
FIG. 11C is a perspective view of the fastener of FIG. 11A from the opposite side from that of FIG. 11B.
Figure 11D:
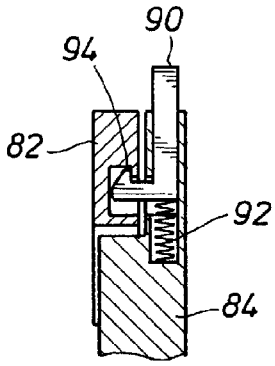
FIG. 11D is a detail section view of a latch mechanism for the fastener of FIGS. 11A, 11B, and 11C.

I have found that depressing the button 34 as illustrated in FIG. 8 is quite easy to do. This is because the entire loop of the frame 16 is bent or flexed, providing a significant mechanical advantage over the lever arm of the frame. However, some users may find even this slight amount of pressure to be a drawback in the operation of the fastener. FIG. 9 illustrates one solution to this drawback. A fastener 60 includes a frame 62, a back plate 64, and one or more hole-engaging pins 66 extending up from the back plate 64. The frame 62 and the back plate 64 are joined together at a hinge 68 for rotational movement relative to one another. In this embodiment, however, the frame is spring loaded into the back plate with a biasing means such as a spring 70. Thus, the frame moves in a direction parallel to the long edge of the belt 12.

The frame 62 also includes a notch 74 adapted to fit around a retainer pin 76 when the frame is depressed in the direction of the arrow 72. When the frame is rotated into a receiving member 78 and the spring 70 is depressed, the notch 74 clears the retaining pin. When pressure is released from the frame, spring pressure moves the frame back into a rest position, the frame is then retained within the receiving member until easily released by again depressing the frame to squeeze the spring 70. It should also be noted that the biasing means may also be mounted with the frame-receiving member 78, within the scope and spirit of this invention.

Alternatively, the biasing means may be mounted within the frame as shown in FIGS. 10A through 10F. One advantage of the embodiment shown in FIG. 9 is that it is simple and easy to manufacture. One the other hand, it suffers the drawback in that it does not include the cross member 22 (FIG. 1), so it is not as robust as other embodiments and it not as effective in capturing a belt or strap inserted therethrough. The embodiment of FIGS. 10A through 10C solves these and other drawbacks.

Figure 10A:
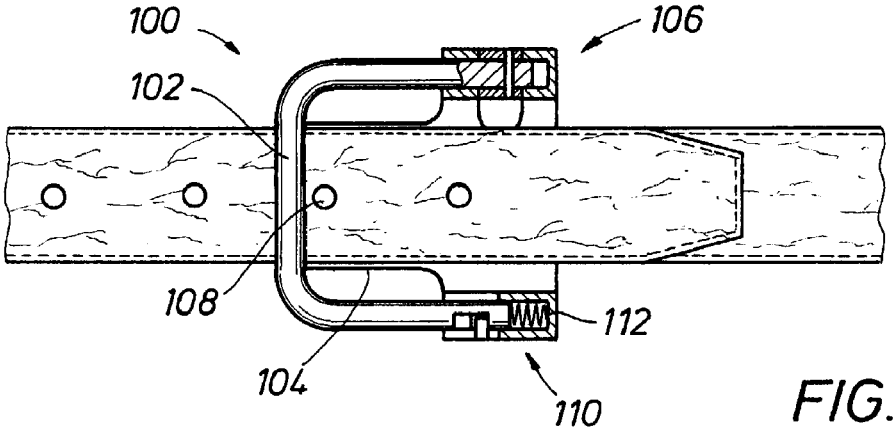
FIG. 10A is a top section view of a fastener of this invention with a latch mechanism provided within a rotation portion of a frame, shown in the latched position.
Figure 10B:
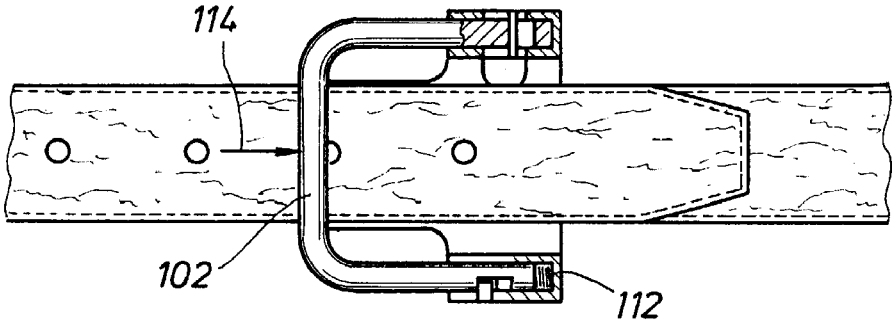
FIG. 10B is a top section view of the fastener of FIG. 10A, shown in the released position.
Figure 10C:
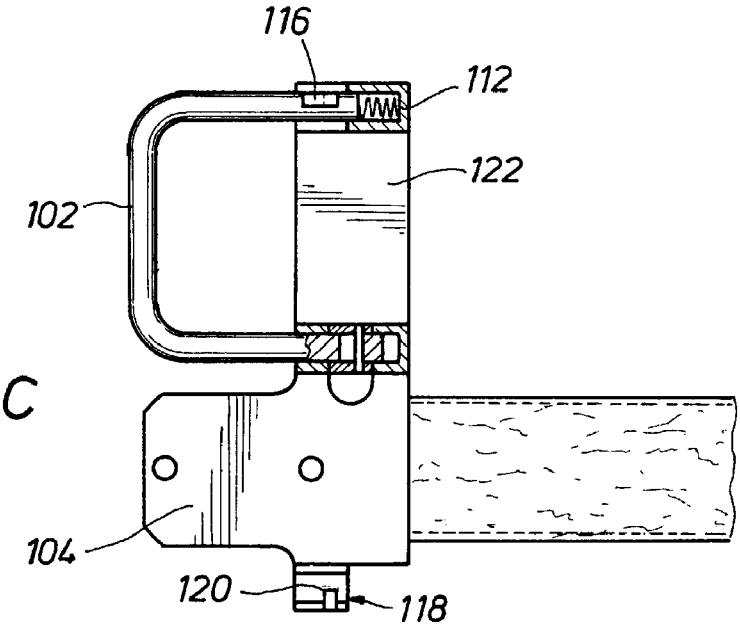
FIG. 10C is a top section view of the fastener of FIG. 10A, shown in the open position.

FIG. 10A shows a fastener including a frame 102 and a back plate 104, coupled together with a hinge 106 for relative rotational movement between them. The back plate includes a pair of hole-engaging pins 108. The end of the frame opposite the hinge 106 includes a latching mechanism 110. In a manner similar to that described in respect of FIG. 9, a spring 112 maintains a rest position for the frame. FIG. 10B shows the frame moved in a direction shown by an arrow 114, so that the spring 112 is compressed. As shown in FIG. 10C, the end of the frame which includes the latch mechanism also includes a notch 116. Also, the back plate includes a latch receiving member 118 which defines a retaining pin 120. When the frame is depressed as in FIG. 10B, the latch mechanism is released by having the notch 116 clear the retaining pine 120. The frame is then free to pop open, as in FIG. 10C. Note in this embodiment that this latch arrangement leaves adequate room to includes a cross member 122.

When closing the fastener from the position shown in FIG. 10C, the frame is rotated back to the latch receiving member 118, the retaining pin abuts the frame adjacent the spring, thereby compressing the spring 112 until the frame is received into the latch receiving member 118. The frame is then forced into the rest position of FIG. 10A by action of the spring.

FIGS. 10A through 10D, inclusive, illustrate the present invention applied to an H-shaped buckle or clasp 80. In this embodiment, a frame 82 is coupled to a tongue 84 at a hinge 86. The tongue is normally retained joined to the frame 82 with a latch mechanism 88, shown in more detail in FIG. 10D. A latch release button 90 is spring loaded with a spring 92 to release the latch mechanism by lowering an engaging member 94 so that the tongue 84 can be rotated about the hinge. In use, a belt, such as the belt of a raincoat or the like, is laid across the frame 82 and the tongue is closed over the belt until the latch is secured.

Those of skill in the art will recognize many alterations and adaptations of the preferred embodiment just described. For example, the present invention as just described is preferably formed of a copper based alloy, such as brass or bronze, to eliminate some of the problem associated with oxidation of iron based metals, although a stainless steel or chromed material is contemplated. However, an inexpensive version is also contemplated in which the entire structure is formed of plastic, with the hinge defined by a folding line or reduced thickness portion.

Furthermore, the attachment of the fastener of this invention has been described variously as riveted or screwed to the belt or strap. If rivets are used, then when the belt is worn out, then in order to reuse the fastener as new belt or strap must be riveted to the fastener. If screws are used, then this drawback is eliminated. Also, other types of releasable mounts for belts are well known in the art, and may also be easily adapted to the fastener of this invention.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A buckle for securing a belt having a long edge, a first end secured to the buckle and a second, free end, the belt further having a plurality of holes therethrough, the buckle comprising:

a. a frame;

b. a backplate coupled to the frame at a hinge for rotation about an axis parallel to the long edge of the belt;

c. a first hole-engaging pin extending from the backplate and adapted to engage one of the plurality of holes in the belt;

d. a button on a first end of the frame and further; and e. an outwardly extending edge on the chamber thereby defining a latch mechanism for latching the buckle and opening the buckle by depressing the button towards the hinge.

2. The buckle of claim 1, further comprising a cross member extending across the frame and forming part of the hinge.

3. The buckle of claim 2, further comprising a chamber in the cross member to movably retain a first end of the frame.

4. The buckle of claim 1, further comprising a second hole-engaging pin extending from the back plate.

5. The buckle of claim 4, wherein the first and second hole-engaging pins are on a line parallel to the long edge of the belt.

6. The buckle of claim 4, wherein the first and second hole-engaging pins are on a line perpendicular to the long edge of the belt.

7. The buckle of claim 1, further comprising a faux tongue affixed to the frame and extending toward but not through the belt.

8. The buckle of claim 1, wherein the frame defines a U-shaped loop having a first end and a second end, and further wherein the first end of the frame defines a part of the hinge, and further wherein the second end of the frame defines a latching mechanism.

9. The buckle of claim 1, further comprising a biasing means in the hinge for translational movement between the frame and the backplate.

10. The buckle of claim 9, further comprising:

a notch in the frame; and b. a frame-receiving member extending from the back plate, the frame-receiving member including a retaining pin to secure the frame to the frame-receiving member.

11. A clasp for securing a strap having a long edge, a first end coupled to a body, a second free end, the strap further having a plurality of holes therethrough, the clasp comprising:

a. a frame;

b. a backplate coupled to the frame at a hinge for rotation about an axis parallel to the long edge of the strap;

c. a first hole-engaging pin extending from the backplate and adapted to engage one of the plurality of holes in the strap;

d. a button on a first end of the frame and; and e. an outwardly extending edge on the chamber, thereby defining a latch mechanism for latching the clasp and opening the clasp by depressing the button towards the hinge.

12. The clasp of claim 11, further comprising a cross member extending across the frame and forming part of the hinge.

13. The clasp of claim 12, further comprising a chamber in the cross member to movably retain a first end of the frame.

14. The clasp of claim 11, further comprising a second hole-engaging pin extending from the back plate.

15. The clasp of claim 14, wherein the first and second hole-engaging pins are on a line parallel to the long edge of the strap.

16. The clasp of claim 14, wherein the first and second hole-engaging pins are on a line perpendicular to the long edge of the strap.

17. The clasp of claim 11, further comprising a faux tongue affixed to the frame and extending toward but not through the strap.

18. A buckle for securing a belt having a long edge, a first end secured to the buckle and a second, free end, the belt further having a plurality of holes therethrough, the buckle comprising:

a. a frame;

b. a backplate coupled to the frame at a hinge for rotation about an axis parallel to the long edge of the belt; and c. a first hole-engaging pin extending from the backplate and adapted to engage one of the plurality of holes in the belt; and d. a biasing means in the hinge for translational movement between the frame and the backplate.

* * * * *